US005907121A

United States Patent [19]

Fritze

[11] Patent Number: 5,907,121

[45] **Date of Patent: *May 25, 1999**

[54] BLANK CARTRIDGE FOR FIREARMS

[76] Inventor: Wolfhart Fritze, Hasenlohweg 8, CH-6315 Oberageri, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/764,360

[22] Filed: Dec. 12, 1996

[30] Foreign Application Priority Data

Dec. 13, 1995 [DE] Germany ..... 195 46 582

[51] Int. Cl.[6] ..... F42B 8/04

[52] U.S. Cl. ..... 102/530; 102/435; 102/439; 102/444; 102/529

[58] Field of Search ..... 102/435, 439, 102/442, 444–447, 511, 529, 530, 531

[56] References Cited

U.S. PATENT DOCUMENTS

| | | | |
|---|---|---|---|
| 1,678,162 | 7/1928 | Pedersen | 102/435 |
| 1,690,890 | 11/1928 | De Geynst et al. | 102/530 |
| 1,804,986 | 5/1931 | Holden et al. . | |
| 3,356,029 | 12/1967 | Seidel . | |
| 5,151,557 | 9/1992 | Bracuti et al. | 102/435 |

FOREIGN PATENT DOCUMENTS

| | | | |
|---|---|---|---|
| 00 44 643 A1 | 1/1982 | European Pat. Off. . | |
| 2308900 | 11/1976 | France | 102/530 |
| 62103 | 5/1892 | Germany | 102/530 |
| 16 99 603 | 6/1955 | Germany . | |
| AS1 239 961 | 5/1967 | Germany . | |
| 70 16 258 U1 | 4/1970 | Germany . | |
| 30 08 144 A1 | 9/1981 | Germany . | |
| 38 15 436 A1 | 11/1989 | Germany . | |
| 7564 | 4/1891 | United Kingdom | 102/530 |
| 17723 | 7/1892 | United Kingdom | 102/530 |
| 273214 | 6/1927 | United Kingdom . | |
| 924 390 | 4/1960 | United Kingdom . | |
| 997628 | 7/1965 | United Kingdom | 102/444 |
| 1016585 | 1/1966 | United Kingdom | 102/444 |
| 1578279 | 11/1980 | United Kingdom . | |

OTHER PUBLICATIONS

Rheinmetall, 7th Edition, pp. 465 and 518 (1980) (German).

*Primary Examiner*—Harold J. Tudor
*Attorney, Agent, or Firm*—Lyon & Lyon LLP

[57] ABSTRACT

The invention concerns a blank cartridge for firearms, with a cartridge casing, whose dimensions correspond to a comparable live cartridge, a propellant charge, and a projectile which can decompose in the barrel of the firearm. The projectile is comprised of a material which contains particles of explosive material and, consequently, deflagrates automatically after the ignition caused by firing (while still in the barrel) and, thus, is consumed within an interval of time which is shorter than the time in which an otherwise identical noncombustible projectile requires to arrive at the muzzle. The decomposition of the projectile does not take place mechanically, but rather thermally and reactively, whereby only a mixture of gases comprising propellant gases and the gaseous remains of the projectile come out of the muzzle, thus substantially eliminating the need for any safety zone in front of the muzzle. According to one embodiment, the projectile material may further comprise an anti-corrosion and/or barrel-lubricating additive which vaporizes upon combustion, while the deflagrating projectile passes through the barrel, and is deposited on the respective adjacent inner wall of the barrel.

27 Claims, 1 Drawing Sheet

BLANK CARTRIDGE FOR FIREARMS

FIELD OF THE INVENTION

The invention concerns a blank cartridge for firearms, with a cartridge casing, whose dimensions at least in the bottom region correspond to a very similar live cartridge, a propellant charge, and a projectile which can decompose in the barrel of the firearm.

BACKGROUND OF THE INVENTION

A blank cartridge of this type corresponds to the blank cartridges as they have been used for some one hundred years and are still used in many countries in weaponry.

In such a known blank cartridge the projectile of the live cartridge is replaced by a hollowed, slightly under-calibrated wooden projectile, which is supposed to be broken down into small splinters by the highly aggressive propellant charge powder, if possible still inside the barrel, such that these splinters cannot injure persons even shortly after leaving the muzzle.

Actually, in practice it has turned out, however, that a hazardous zone of 10 m in front of the muzzle must be taken into account.

Such a blank cartridge has the advantage that its spent casing corresponds in its dimensions exactly to the spent live cartridge; actually, the cartridge casings of live cartridges which have already been fired have been reused for blank cartridges.

However, a disadvantage is that due to the low projectile weight and gas pressure such blank cartridges cause no recoil or gas pressure which is necessary for the reloading of automatic weapons, while, on the other hand, the wood splinters generated during firing prevent the use of a training cartridge device which narrows the muzzle and thus dams up the propellant gases.

Now, on the one hand, it has been proposed to use a projectile jacket, filled with metal powder and which breaks down, as a training projectile (DE-AS 1 239 961), whose weight approximates that of the live projectile, but which, as a result of its pronounced-spin, is supposed to break down immediately after leaving the muzzle. An automatic loading weapon may be loaded with such a blank cartridge; however, there are significant safety reservations against the general use of a projectile of this design.

On the other hand, blank cartridges in which the casing bottom made of metal is fastened in a plastic casing on the front of which the hollow projectile is formed in one piece are used nowadays to a large extent; in the tip of the hollow projectile a predetermined breaking point is formed, which bursts open upon firing such that the resultant damming provides for the proper burning away of the charge which consists of a fast-burning powder similar to a shotgun powder.

The danger that, upon firing, parts of the plastic hollow projectile will fly off is certainly slight, however, it does exist and must thus not be overlooked, if no training cartridge device is used. With a training cartridge device attached, however, a weapon uses such blank cartridges largely safely and problem-free, as long as the plastic jackets of the blank cartridges do not melt in a hot cartridge chamber. A prerequisite for this is, however, that the spent blank cartridges cause no problem during ejection, since they are clearly longer that an empty cartridge casing of a live cartridge. Unfortunately, there is now a significant number of weapons which do not eject such blank cartridges without problems, such as automatic reloading weapons built into vehicles with a casing sack or a casing ejection channel.

During maneuvers, the shooters then learn the elimination of frequent loading obstacles which do not occur at all in live shooting, and, in the process, too easily lose confidence in the weapon.

Blank cartridges are also known in which a hollow cylinder is formed on the neck of the metal casing whose opening is flanged inward such that this hollow cylinder has the external shape of the projectile.

Upon firing, the hollow cylinder unfolds and remains on the casing such that on the whole the same problems result as with the above-described plastic blank cartridges.

And finally, with the firing of blank cartridges of absolutely all types, the oil or grease film which is intended to protect the barrel surface from corrosion, bums away, since a regreasing of the barrel by projectiles as has been known for centuries cannot occur. Multiday maneuvers in bad weather thus result in damage to the weapons used because experience has shown that the instruction to shooters to swab the barrels from time to time is not followed.

There is a particular problem when blank cartridges of the type described are to be used in filmmaking, in particular along with a training cartridge device: There, because of lighting a more pronounced muzzle flash is required than is adequate and appropriate for military training purposes.

It is not possible simply to increase the amount of the propellant charge since because of the very rapidly burning powder, this is already somewhat critical.

On the other hand, it is not simply possible to add magnesium powder or a similar illuminant to the propellant charge, since the burning behavior of the propellant charge may be drastically altered by this. Also, pieces of the illuminant, which burns at an extremely high temperature are sprayed into the surface of the inside wall of the barrel, where they may cause or trigger damage.

And finally, it must be taken into account that particularly high demands must be placed on the safety of blank cartridges which are to be used in filmmaking or the like since when he fires, the respective actor is not concentrating primarily on the handling of the weapon, as does a soldier in maneuvers, but rather on the portrayal of the character he is playing.

In EP 00 44 643 A1, it has been proposed to use a projectile made of polyurethane for a blank cartridge, which is supposed to be completely consumed while still in the barrel of the weapon, whereby it is assumed that the particles of the polyurethane projectile shattered by the firing acceleration come into contact with the excess oxygen of the propellant gases and thus possibly burn up; however, it is more likely that at least part of these particles might leave the muzzle without having burned. Thus, with these prior art blank cartridges, safety reservations persist.

The technical manual of weaponry "Rheinmetall", 7th ed. 1985, pages 465 and 518, shows the blank rifle cartridge ("training ammunition") used by the German Bundeswehr made of a closed-front plastic casing provided with a predetermined breaking point in the form of a cartridge on the back end of which a metal bottom with an igniter is inserted. When fired, the casing bursts. The spent cartridge is not intended to be reloaded.

DE 70 16 258 U1 presents a blank cartridge which works on the same principle: However, the plastic casing which has a predetermined breaking point on its front end is designed not in the shape of a complete cartridge, but rather only as a projectile; this projectile-shaped plastic casing sits solidly in the cartridge casing, for example, in the center of a flange.

Utility model DE 16 99 603 presents a blank or gas cartridge which was commercially available in the 1950s under the tradename "Wadie" and had a so-called "blank charge" of loose powdered material over a propellant charge, which can, for example, consist of coarse grain (as a blank cartridge), perfume-soaked asbestos powder (as a perfume cartridge), flash powder, or a mixture of black powder and flash powder (as a flash powder cartridge) or soot (as a smoke cartridge). The burning of the powdered "blank charge" serves in this case merely for effect. To intensify this effect, if possible, burning outside the muzzle must be sought. Actually, the effect occurs in cartridges with low thermal energy and low firing pressure—as in the Wadie cartridges—that a relatively large proportion of propellant powder is ejected unconsumed from the barrel. Now, if one loads a flash charge as a projectile, so to speak, before the propellant charge, then it is to be expected that the greater part of it will not ignite, but is simply ejected from the muzzle. Of the possibilities mentioned in the published utility model, only the blank cartridge, the gas cartridge, and the perfume cartridges of "Wadie" are known; to our knowledge a flash cartridge was never produced. On the whole, this cartridge is known only as a curiosity.

DE 38 15 436 A1 concerns a molded propellant charge made of powder grains and binder for artillery cartridges. Molded propellant charges are also known in casingless small arms cartridges. In each case the propellant charge (but not the projectile) is laced with binder. If one wished to implement the teaching of this published patent in a blank cartridge, the "blank charge" would, however, have to remain in powder form in order to avoid obstructions in the weapon resulting in a dangerous increase in pressure which would prevent the firing of projectiles.

DE 30 08 144 A1 concerns "combustible molded pieces of ammunition" made of felt. This means hollow molded forms of felt to accommodate a propellant charge for the artillery. The purpose of these molded forms of felt is to burn out during and after firing so that the next loading procedure is not blocked by old charge residues.

Patent GB 924 390 concerns an artillery training cartridge (caliber greater than 40 mm) with a reusable outer casing, in which a projectile-shaped plastic body and a type of inner blank cartridge are removably fastened, possibly screwed in. The body has predetermined break points and operates in principle like the aforementioned Bundeswehr training cartridge. The inner blank cartridge is screwed from the front into a central continuous open neck formed in the base and has an igniter, which connects flush with the base after incorporation of the inner blank cartridge. After firing of the training cartridge, the residues of the projectile-shaped body and the spent inner blank cartridge are removed and replaced by a new body and a new blank cartridge, respectively. It also concerns creating an exchangeable blank cartridge load, the diameter of which is small enough that it passes through the neck of the cartridge.

U.S. Pat. No. 1,804,986 concerns a blank cartridge which consists of a relatively small caliber standard blank cartridge and an adapter for the weapon actually used. The adapters may be produced as turned parts, collected after firing, and reloaded with a new blank cartridge. Thus it is possible to produce a large number of different types of cartridges simply and inexpensively.

SUMMARY OF THE INVENTION

Starting from the above problems, the object of the invention is to provide a blank cartridge which at least partially remedies the above-described prior art problems.

This object is accomplished by a blank cartridge for firearms with a cartridge casing whose dimensions, at least in the bottom region, match those of a very similar live cartridge, a propellant charge, and a projectile which can decompose in the barrel of the firearm, which is characterized in that the projectile is made of a material which contains particles of explosive material and, consequently, deflagrates automatically after the ignition caused by firing while still inside the barrel.

The blank cartridge according to the invention has the advantage that its dimensions completely correspond to those of the live cartridge both before and after firing such that it is possible to fire without any problems in an automatic weapon with a training cartridge device. In an embodiment with a somewhat shortened cartridge casing, the correspondence with the dimensions of the live cartridge after firing is retained to a large extent—aside from the slight shortening.

The decomposition of the projectile in the barrel does not take place, as in the prior art, mechanically, but rather thermally and reactively, whereby it is not wood splinters which come out of the muzzle, but rather only a mixture of gases composed of the propellant gases and the gaseous remains of the projectile.

Here, it is conceivable for the layman to select a projectile material which vaporizes while still in the barrel solely from the amount of heat applied by the propellant charge. However, in practice, it is impossible to master the disruptive thermal boundary conditions; the suggestions known from the non-technical literature to use projectiles made of wax or of Wood's metal are all known to be inoperable: Such projectiles exit the muzzle still largely solid and intact, but already melt in a moderately warm cartridge chamber.

The projectile of the blank cartridge according to the invention is made, in contrast, of a pyrotechnic material, which, after the ignition caused by firing, is automatically consumed within an interval of time which is shorter than the time which an otherwise identical noncombustible projectile requires to arrive at the muzzle. The term "explosive materials" refers, in particular, to propellant charging powders, solid propellants, explosives, mixtures of explosives, primers, mixtures of primers, igniter mixtures, and pyrotechnic materials. Preferably, here, "explosive materials" means nitropowder or explosive, e.g., Octogen, as is used in cartridges for small arms and which may be similar to or be the same as the powder of the propellant charge.

Preferably, a powder which is at least equally or even more readily ignitable than that in the propellant is used such that, even when because of a problem (too lengthy storage, penetration of moisture into the cartridge), the propellant charge only burns incompletely, complete ignition and thus consumption of the projectile material is provided for in every instance.

Since only gases of the projectile remain at the muzzle, the blank cartridge according to the invention may be fired completely problem-free in a weapon with a training cartridge device.

However, it is also guaranteed that if a weapon without a training cartridge device is used, no solid particles whatsoever can come out of the weapon, with the exception of a very few unburned powder particles. The necessary safety zone in front of the muzzle is only as long as necessary because of the gases flowing out.

Even if a blank cartridge according to the invention is fired in a weapon for which it is not intended, whose barrel is significantly shorter than that for which the blank cartridge is designed, perhaps the already partially deflagrated projectile could exit the muzzle and not be completely consumed until shortly thereafter. In this case, the safety zone would, however, be extended by only a few centimeters. Such a case is conceivable if a cartridge designed for a submachine gun is fired from a pocket pistol equipped for this same cartridge, whose barrel is significantly shorter than that of the submachine gun.

However, it is also possible to design the projectile material such that the projectile is completely consumed long before reaching the muzzle.

In principle, the projectile may be made of a homogeneous explosive material or mixtures such as are used as propellants in small weapons. Deflagrating times may be determined by suitable porosity, surface design, and structural form of the imitation projectile.

According to one embodiment of the invention, it is advantageous that the particles of explosive material be held together by a binder. By selection of the type of the binder and its proportion along with the powder selected, it is possible to adjust the combustion speed very accurately, whereby it is ensured with a suitable binder that the projectile is not damaged or totally demolished by the handling of the blank cartridge before firing, e.g., during loading in an automatic weapon.

But even if the projectile of the blank cartridge according to the invention should, in the worst case, be present in fragments in the cartridge chamber, with the use of an adequately ignitable powder, each of the fragments is immediately ignited when the propellant gases of the propellant charge or the combustion gases of another of the projectile fragments reach it, such that in each case, it is guaranteed that all fragments of the projectile are fully consumed before reaching the muzzle.

Preferred as binders are organic materials, e.g., polymers, which give the structures made of the projectile material a tough stability and effectively prevent the occurrence of fractures or crumbling.

Thus, with the blank cartridge according to the invention, multiple loading and unloading is also possible without the projectile showing signs of wear and tear.

In principle, the projectile material may include additives, such as a dye, which visibly identifies the projectile and thus makes the corresponding cartridge recognizable as a blank cartridge.

This circumstance is particularly significant since the same cartridge casings can be used for blank cartridges as for live cartridges, such that for example, a machine gun belt filled with blank cartridges according to the invention could be mistaken even at a short distance with a belt loaded with live cartridges if the clear marking of the projectiles were not present.

But on the other hand, an advantage of the blank cartridges according to the invention consists in that their cartridge casings may, in contrast to the plastic casings of the currently used blank cartridges, be reused.

According to another, preferred embodiment of the invention, the projectile material includes an anticorrosive and/or barrel lubricating additive, which vaporizes upon combustion while the deflagrating projectile passes through the barrel, and is deposited on the respective adjacent inner wall of the barrel.

Even if part of this lubricating or anticorrosive protective film burns with each shot, this film is always renewed such that the weapon fired with blank cartridges according to the invention is always protected from direct corrosion damage inside the barrel and in the training cartridge device.

The projectile material may have, instead of or in addition to the additives described, other such materials which affect the color and/or the intensity of the muzzle flash. Metal additives, which may, for example, drastically affect the combustion behavior of the propellant charge are delayed or reduced in their effect by being embedded in the binder such that they may be used without problems as additives in the projectile material.

Thus it is first possible to intensify the muzzle flash with control such as is desirable or necessary in filmmaking.

It is, however, also possible to affect the spectrum of the muzzle flash such that the shooters or the troop division firing may be recognized from the color of the muzzle flash. This coloring need not be visible to the naked eye; thus it is possible, for example, for a training referee to distinguish between the training parties with a simple infrared sensor only from their muzzle flash and thus more accurately and better follow a maneuver if one training party uses blank cartridges whose muzzle flash has a clearly higher infrared component than the muzzle flash of the blank cartridges of the other training party.

Until now, an on the whole substantially homogeneous projectile made up of a mixture of powder particles, binder, and, if need be, additives, has been assumed.

If is, however, possible and advantageous, if appropriate, to design the projectile in multiple parts whereby the individual components have a composition differing among themselves, which always corresponds, however, in principle and preferably to the type described above.

Thus, advantageously the projectile according to the invention has in one embodiment of the invention a projectile jacket and core of which the material of the projectile jacket is optimized with regard to abrasion resistance and breaking strength whereas the material of the projectile core may be optimized with regard to ignitability and combustion behavior.

Since in this case the projectile core will always be consumed a little before the projectile jacket, the projectile jacket remains in contact with the wall of the barrel until shortly before the residue-free release of the projectile, whereby the acceleration of the projectile is better defined. Moreover, the projectile jacket can have as an additive a grease or a lubricant either of which is rubbed on the wall of the barrel during firing. The lubricant may form an outer layer of the projectile, roughly in the form of an outer, paint-like coating of such a lubricant.

Since the combustion of the projectile core occurs in the immediate vicinity of the projectile jacket, the latter may even be made of a non-reactive material such as plastic, as long as it is readily combustible and thin enough.

This plastic jacket may, if necessary, simultaneously form moisture and oil protection for the projectile material according to the invention.

The projectile according to the invention may be considered a multilayered block of binder, e.g., polymer material, which is interspersed with nitropowder or another explosive material and may be to a certain extent resilient.

Such a projectile may in principle be attached by mere clamping in the neck of the casing, but has, according to a preferred embodiment of the invention, a circumferential bead in which an inwardly turned casing edge engages. The projectile is thus form-fittingly attached in the casing and may also, if it encounters an obstacle during automatic loading, not be shifted in its position.

Simultaneously, this form-fitting mount forms a certain damming which ensures that the projectile is not moved until a certain propellant gas pressure has built up in the cartridge, which in turn ensures a safe ignition of the projectile. Thus, it is prevented with a backfire (delayed ignition) that the slight explosion pressure of the ignition cap already pushes the projectile into the barrel, before the propellant charge has ignited.

With a live cartridge the entire interior of the cartridge casing is often not completely filled with powder, but rather there is often still a free space which is necessary so that upon firing the gas pressure does not exceed an admissible limit.

Likewise, the blank cartridge powder often does not completely fill the entire interior of the cartridge casing; thus it is possible upon firing that there is an intermediate space between the propellant charge and the projectile which impairs the ignition of the projectile.

Consequently, it is proposed according to the invention, to apply the propellant charge to the projectile or to keep it in constant contact therewith, such that when the propellant charge ignites, the ignition of the projectile is ensured in each instance.

Here, the interior of the cartridge casing may be reduced such that the propellant charge is always in contact with the projectile.

According to another, preferred embodiment, the propellant charge is however designed as a pellet of explosive material or as a casingless body of explosive material and applied to the base of the projectile or designed in one piece with the projectile.

This solid propellant charge is preferably designed as a tube and disposed such that it extends coaxially through the cartridge casing and ends a short distance above the ignition bore in the bottom of the casing or is seated around it on the bottom of the casing.

Thus extremely high ignition safety is guaranteed for the projectile since when the solid propellant charge connected preferably in one piece with the projectile ignites, the projectile, which constitutes, so to speak, an extension of the propellant charge, also ignites.

The propellant charge need not be tubular and may have any other suitable form; the tubular design has, however, the advantage of extremely safe ignition and uniform combustion.

An additional advantage of this embodiment lies in that the use of a charging element which consists of a combustible projectile with a propellant charge body attached which makes reloading of blank cartridges using already fired or new cartridge casings very easy since only the charging element has to be inserted in the re-encapsulated and, if need be, recalibrated casing. Thus, in a movie studio, for example, only a number of charging elements of various calibers according to the invention, which may then be loaded as needed into the respective necessary cartridge casings, need be kept on hand. One and the same charging element with a projectile of the caliber 0.45 may be used, for example, for such different cartridges as 0.45–70 government or 0.458 Winchester Magnum. If the propellant charge body of such a charging element is shortened, it may also be used for short cartridges such as 0.44–40, 0.45 Colt or the like—all cartridges, which to date had to be filled with a measured charge and preloaded with a suitable projectile capable of being broken down.

Another embodiment of the invention consists in that the projectile and the propellant charge form a single, unified charging body which may, for example, be designed as a molded body. The propellant charge and the projectile are made of the same explosive material, which may be provided with binders and, if need be, with additional additives. The solid charge body presents the same advantages as the preceding embodiment of the invention, but also has the advantage of being less likely to fracture and thus simpler to handle.

In the above it has been assumed that the blank cartridges have the same cartridge casings as the live cartridges. It is, however, advantageous to use a cartridge casing which is shorter than the live cartridge and which, consequently, may be produced from less ductile material or quite simply from less material. The shape of the live cartridge is increased by the complementary shaped charging body which extends forward beyond the shortened cartridge casing. Thus, the production of the blank cartridge is made less expensive.

If the live cartridge is a bottle-shaped cartridge, as are most modem military cartridges, it is advantageous to let the cartridge casing of the blank cartridge extend only to the shoulder of the bottle shape and thus to design it substantially cylindrical, while the charging body forms the shoulder of the blank cartridge and its projectile, and is thus on the whole larger than the caliber of the barrel. This results in a certain damming which holds the charging body back for a short time, provides for an increase in pressure in the cartridge chamber, and ensures that the charging body ignites completely and is consumed.

The charging body may contain the entire propellant charge; however, it is also possible to fill in part of the propellant charge under the charging body preferably loosely in the cartridge casing. This loose part of the propellant charge may be designed as a detonation charge with a higher temperature of combustion to ensure reliable ignition of the charging body.

It remains to be noted that with the blank cartridge according to the invention, no residues remain in the field, such as nondecomposable plastic splinters or the like; only the casings must be collected; but they can be reused.

The object of the invention is further explained with reference to the accompanying schematic drawings. They depict:

DETAILED DESCRIPTION OF PREFERRED EMBODIMENTS

Figure 1:
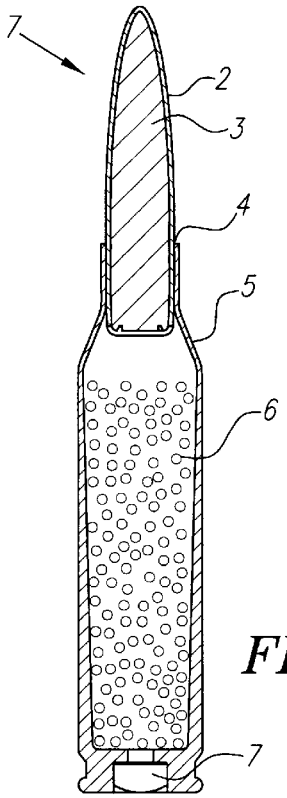
FIG. 1 a first embodiment of a blank cartridge according to the invention, enlarged and in perspective.

FIG. 1 depicts a blank cartridge which is designed in principle like a live cartridge:

A cartridge casing 5 filled with a loose propellant charge 6 of nitropowder has in its casing base a pressed in ignition cap 7, which is connected via an ignition bore with the interior of the cartridge casing and the propellant charge 6. The nitropowder of the propellant charge 6 is, however, by its type significantly more rapid deflagrating that a nitropowder which is used for a live cartridge.

In the neck of the cartridge casing 5 sits a projectile 1, which has an annular bead 4 into which the edge of the cartridge casing 5 is pressed.

The projectile 1 has a projectile core 3 which opens on the projectile bottom into the cartridge casing 5; the other external surfaces of the projectile core 3 are covered by a projectile jacket 2.

In contrast to a live cartridge, the projectile core 3 consists of a homogeneous mixture of a suitable binder (e.g., a polymer) and explosive material (e.g., nitropowder), to which, if need be, are added additives for corrosion protection of the interior surface of the barrel of the weapon firing the blank cartridge and for control of the brightness of the muzzle flash generated.

This projectile material is prepared such that it deflagrates completely upon firing without solid residues, before it has reached the muzzle of the firing weapon.

The jacket 2 may likewise be made of a mixture of a suitable binder (e.g., a polymer) and explosive material (e.g., nitropowder), likewise with additives of the type mentioned, in particular with a dye for visible identification of the projectile. However, the hardness, abrasion resistance, and fracture strength of the material of the jacket 2 are higher than with the projectile core 3.

The jacket 2 is thin enough that it essentially deflagrates along with the core 3 without residue before it has reached the muzzle.

However, the jacket 2 may also be made completely from plastic as long as this is capable of deflagrating completely along with the core 3, i.e., of deflagrating such that no solid residues of projectile components can leave the muzzle.

Thus, the consideration of any safety zone in front of the muzzle of the weapon is unnecessary. Also, any exercise cartridge device may be used. And finally, the blank cartridge according to the invention leaves no environment contaminating residues at all after firing.

The cartridge casing 5 of the blank cartridge depicted is identical to the corresponding live cartridge, however, it may, if need be, be made of a more cost-effective material, such as sheet iron, aluminum, or plastic, since the load on the blank cartridge casing 5 is significantly less on firing than that of the cartridge casing of a live cartridge.

Figure 2:
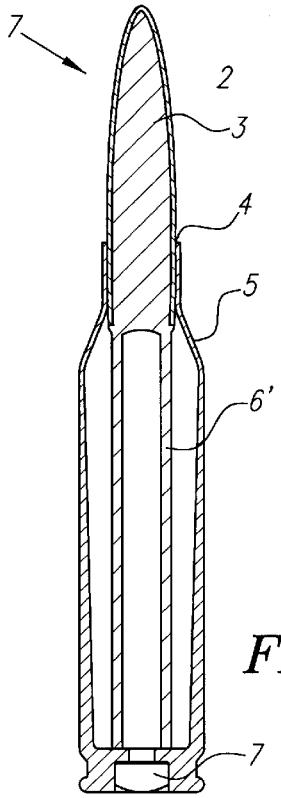
FIG. 2 a depiction as in FIG. 1, but of a second embodiment.

The blank cartridge of FIG. 2 is to a large extent identical to that of FIG. 1, such that its description also applies to FIG. 2, with the exception of the propellant charge 6, which, in the embodiment in FIG. 2 is not designed as loose bulk nitropowder, but rather as a macaroni-shaped propellant body 6', which is designed in one piece with the projectile core 3 and extends beyond the bottom of the projectile 1 concentric thereto to the bottom of the casing, where it surrounds the ignition bore.

The flame of the ignition cap 7 deflagrates the propellant body 6' centrally over the entire circumference of the interior and over a significant part of its length, such that this propellant body 6' deflagrates rapidly and both accelerates and deflagrates the projectile.

The propellant charging body may be made of the same explosive/binder mixture as the projectile core 3; the necessary faster deflagrating is ensured in that the ignition flame of the ignition cap 7 simultaneously ignites a comparatively very large surface of the propellant charging body.

Figure 3:
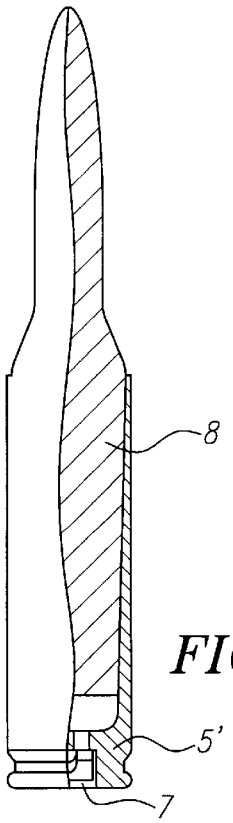
FIG. 3 an additional embodiment.

FIG. 3 depicts another embodiment; in it the cartridge casing 51 is shortened such that it reaches only to the shoulder of the bottle-shaped blank cartridge and is essentially cylindrical on the whole.

A uniform charging body 8 sits in the shortened cartridge casing 51 and extends down into it well past the base such that it may be ignited by the ignition beam of the ignition cap 7.

The charging body 8 extends, with its outer surface, the shape of the blank cartridge, starting from the free edge of the cartridge casing 51 and thus forms the shoulder, the neck, and the projectile of the blank cartridge.

Figure 4:
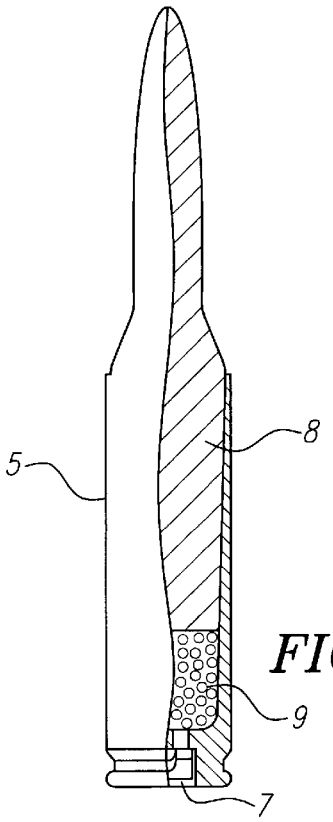
FIG. 4 yet another variant embodiment.

The variant embodiment of FIG. 4 has a charging body 8 whose external shape matches that of the embodiment according to FIG. 3. In the interior of the shortened cartridge casing 51, the charging body 8 does not, however, extend so far down, but rather leaves a charging space free above the ignition cap 7, which is filled with a detonation powder 9.

What is claimed is:

1. A blank cartridge for firearms comprising:

a cartridge casing so dimensioned as to correspond, at least in the bottom region, to a live cartridge;

a projectile engageable with said cartridge casing, and extending outwardly from a front end of said cartridge casing said projectile completely, reactively, and thermally decomposing within a barrel of a firearm, said projectile comprising a material which contains particles of explosive material such that said projectile automatically and completely deflagrates while still inside the barrel of the firearm after ignition of said explosive material upon firing of the firearm and leaves the barrel in a gaseous state; and, a propellant charge in association with said cartridge casing and said projectile.

2. The blank cartridge according to claim 1 wherein said projectile further comprises a binder by which said particles of explosive material are held together.

3. The blank cartridge according to claim 2 wherein said binder comprises an organic material.

4. The blank cartridge according to claim 3 wherein said organic material is selected from the group consisting of plastics and polymers.

5. The blank cartridge according to claim 1 wherein said projectile material further comprises a barrel-lubricating additive.

6. The blank cartridge according to claim 1 wherein said projectile material further comprises an anticorrosion additive.

7. The blank cartridge according to claim 1 wherein said projectile material further comprises an additive which intensifies the muzzle flash.

8. The blank cartridge according to claim 1 wherein said projectile further comprises an abrasion resistant jacket and a core.

9. The blank cartridge according to claim 8 wherein said abrasion resistant jacket and said core have a different material composition.

10. The blank cartridge according to claim 9 wherein said core comprises a more rapidly deflagrating material than said jacket.

11. The blank cartridge according to claim 9 wherein said core comprises a more readily ignitable material than said jacket.

12. The blank cartridge according to claim 8, wherein said cartridge casing comprises an inward turned edge engageable with said projectile and wherein said abrasion resistant jacket comprises an external surface having a circumferential bead for form-fitting engagement with said inward turned edge of said cartridge casing.

13. The blank cartridge according to claim 8 wherein said propellant charge is applied on said projectile core.

14. The blank cartridge according to claim 1 wherein said cartridge casing comprises an inward turned edge engageable with said projectile and wherein said projectile comprises an external surface having a circumferential bead for form fitting engagement with said inward turned edge of said cartridge casing.

15. The blank cartridge according to claim 1 wherein said propellant charge is applied on said projectile.

16. The blank cartridge according to claim 1 wherein said propellant charge further comprises a hollow central column connected to said projectile and extending axially and substantially to the bottom of said cartridge casing.

17. The blank cartridge according to claim 3 wherein said propellant charge further comprises a hollow central column integral with said projectile.

18. The blank cartridge according to claim 8 wherein said propellant charge further comprises a hollow central column connected to said projectile and extending axially and substantially to the bottom of said cartridge casing.

19. The blank cartridge according to claim 8 wherein said propellant charge further comprises a hollow central column integral with said projectile.

20. The blank cartridge according to claim 1 wherein said projectile and at least a part of said propellant charge form a single, uniform charging body.

21. The blank cartridge according to claim 20 wherein said cartridge casing is substantially cylindrical having a front end and a bottom.

22. The blank cartridge according to claim 21 wherein said charging body extends axially within said cartridge casing from substantially at the bottom of said cartridge casing to at least the front end of said cartridge casing.

23. The blank cartridge according to claim 21 further comprising detonation powder disposed about the bottom of said cartridge casing.

24. The blank cartridge according to claim 23 wherein said charging body extends axially within said cartridge casing from substantially at said detonation powder to at least the front end of said cartridge casing.

25. The blank cartridge according to claim 22 wherein said charging body extends outwardly from the front end of said cartridge casing, and wherein the portion of said charging body which extends outwardly from the front end of said cartridge casing is so dimensioned as to correspond to the top region of a live cartridge.

26. The blank cartridge according to claim 24 wherein said charging body extends outwardly from the front end of said cartridge casing, and wherein the portion of said charging body which extends outwardly from the front end of said cartridge casing is so dimensioned as to correspond to the top region of a live cartridge.

27. A blank cartridge for firearms comprising:

a cartridge casing;

a projectile engageable with said cartridge casing and extending outwardly from a front end of said cartridge casing, said projectile completely, reactively, and thermally decomposing with a barrel of a firearm, said projectile comprising a material which contains particles of explosive material such that said projectile automatically and completely deflagrates while still inside the barrel of the firearm after ignition of said explosive material upon firing of the firearm and leaves the barrel in a gaseous state; and a propellant charge in association with said cartridge casing and said projectile.

* * * * *